US006508529B2

(12) United States Patent
Rasmussen et al.

(10) Patent No.: US 6,508,529 B2
(45) Date of Patent: Jan. 21, 2003

(54) INKJET PRINTING MEDIA HANDLING SYSTEM AND METHOD FOR REDUCING COCKLE GROWTH

(75) Inventors: Steve O. Rasmussen, Vancouver, WA (US); Steven B. Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/792,935

(22) Filed: Feb. 26, 2001

(65) Prior Publication Data

US 2002/0109740 A1 Aug. 15, 2002

Related U.S. Application Data

(63) Continuation-in-part of application No. 09/163,287, filed on Sep. 29, 1998, now abandoned.

(51) Int. Cl.[7] ..... B41J 29/38
(52) U.S. Cl. ..... 347/12; 347/14; 347/9
(58) Field of Search ..... 347/9, 12, 14, 347/104, 40

(56) References Cited

U.S. PATENT DOCUMENTS

| | | | | |
|---|---|---|---|---|
| 4,207,579 A | | 6/1980 | Gamblin et al. | 347/104 |
| 4,447,817 A | | 5/1984 | Naramore | 347/104 |
| 4,660,752 A | | 4/1987 | Rikard et al. | 226/95 |
| 4,682,904 A | | 7/1987 | Yoshimura et al. | 400/616 |
| 4,821,049 A | | 4/1989 | Eckl | 347/104 |
| 4,843,338 A | | 6/1989 | Rasmussen et al. | 347/104 |
| 5,019,839 A | | 5/1991 | Watanabe et al. | 346/134 |
| 5,077,680 A | * | 12/1991 | Sturm et al. | 358/1.5 |
| 5,123,061 A | | 6/1992 | Pritchard | 382/56 |
| 5,276,970 A | | 1/1994 | Wilcox et al. | 33/18.1 |
| 5,342,133 A | | 8/1994 | Canfield | 400/635 |
| 5,345,863 A | | 9/1994 | Kurata et al. | 101/126 |
| 5,393,151 A | | 2/1995 | Martin et al. | 400/642 |
| 5,419,644 A | | 5/1995 | Martin et al. | 347/8 |
| 5,456,544 A | | 10/1995 | Aoki et al. | 400/642 |
| 5,593,240 A | | 1/1997 | Broder et al. | 347/37 |
| 5,596,423 A | | 1/1997 | Pritchard | 358/433 |
| 5,610,634 A | * | 3/1997 | Murata et al. | 347/5 |
| 5,706,414 A | | 1/1998 | Pritchard | 395/117 |
| 5,730,537 A | | 3/1998 | Kelly et al. | 400/625 |
| 5,800,076 A | | 9/1998 | Umeda | 400/645.3 |
| 5,943,081 A | | 8/1999 | Uchida et al. | 347/104 |
| 5,992,994 A | * | 11/1999 | Rasmussen et al. | 347/104 |
| 6,097,499 A | * | 8/2000 | Casey et al. | 358/1.16 |
| 6,106,115 A | | 8/2000 | Mueller et al. | 347/104 |

FOREIGN PATENT DOCUMENTS

| | | |
|---|---|---|
| EP | 0640479 | 3/1995 |
| JP | 360048385 | 3/1985 |
| JP | 05112001 | 5/1993 |
| JP | 07304167 | 11/1995 |

* cited by examiner

*Primary Examiner*—John Barlow
*Assistant Examiner*—An H. Do

(57) ABSTRACT

When the data rate of incoming data is less than the print speed, there can be pauses in the print job. During a pause, wet ink may cause cockle growth at a portion of the media sheet within the print zone. To reduce such cockle growth a reduced number of nozzles are used when the data rate is less than the print speed. In particular the print swath is reduced. Only a downstream subset of nozzles are used, in effect shortening the portion of the media sheet receiving ink. The wet portion of the media sheet then is closer to the downstream edge of the print zone and soon away from the printhead. A guide shim also is advanced to maintain a flat media sheet near the active nozzles.

14 Claims, 6 Drawing Sheets

FIG. 7
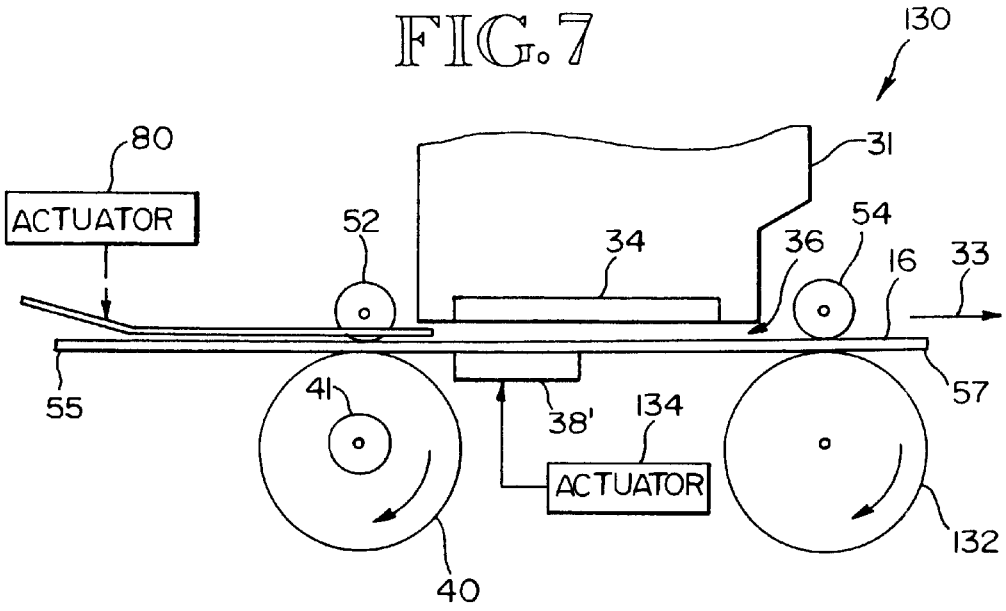
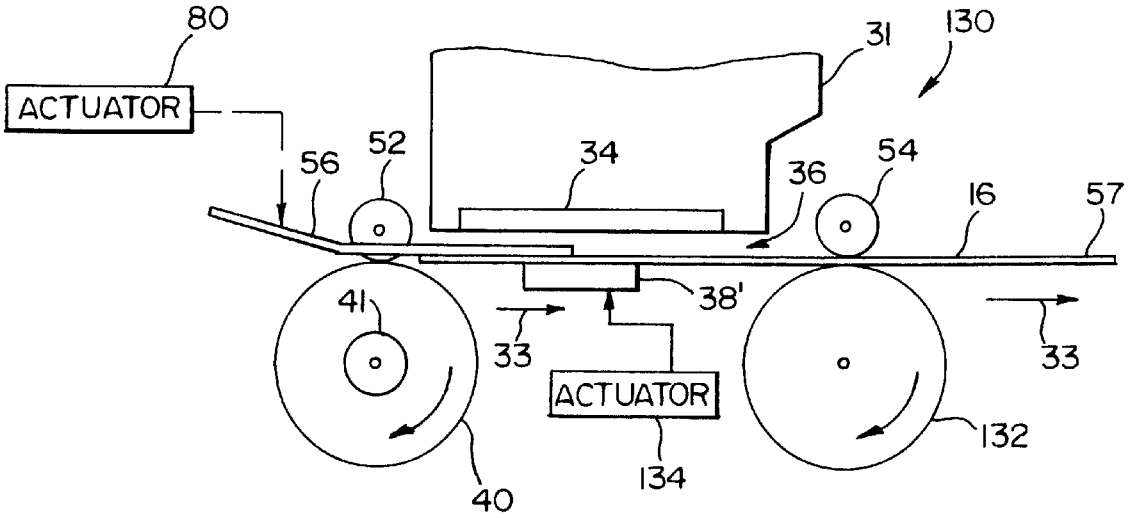
FIG. 8

INKJET PRINTING MEDIA HANDLING SYSTEM AND METHOD FOR REDUCING COCKLE GROWTH

CROSS REFERENCE TO RELATED APPLICATION

This is a continuation-in-part of U.S. patent application Ser. No. 09/163,287 filed Sept. 29, 1998 now of Rasmussen et al. for 'Inkjet Printing Media Handling System and Method for Reducing Cockle Growth'.

BACKGROUND OF THE INVENTION

This invention relates generally to media handling systems for inkjet printing devices, and more particularly to a media handling system which reduces cockle growth on a media sheet during wet ink printing.

Typically ink-jet printers, or any other printers using wet ink, include a printhead and a media handling system. A print zone, a region where printing occurs, is adjacent to the printhead. The media handling system includes a feed mechanism for feeding a media sheet into and through the print zone. The media handling system also includes a platen which underlies the print zone and supports the media sheet as it passes through the print zone.

During printing, ink is dropped, ejected or otherwise output from the printhead into the print zone and onto a media sheet. Ink used in wet ink-type printing includes a relatively large amount of water. As the wet ink contacts the media sheet, the water in the ink saturates the fibers of the media sheet, causing the fibers to expand, which in turn causes the media sheet to buckle. Such buckling action also is referred to as cockling. Cockling of the media sheet tends to cause the media sheet to bend in an uncontrolled manner downward away from the printhead and upward toward the printhead. Cockling varies the printhead to media sheet spacing ('PMSS') and the printhead to media sheet angle ('PMSA'). A constant PMSS and PMSA is desired to assure a desired print quality. Varying these measures, as during cockling, can reduce print quality. In the extreme an upwardly buckling media sheet contacts a pen nozzle causing ink to smear on the media sheet. In a worst case scenario an upwardly buckling media sheet in contact with a nozzle damages the nozzle.

Printhead to media sheet spacing ('PMSS') is defined as the average normal distance from an orifice plate of the printhead to the media sheet (while dry) over the print zone. Alternatively, one or more PMSS's are defined as the respective normal distances from the orifice plate to the media sheet (while dry) at one or more respective locations within the print zone. Printhead to media sheet angle ('PMSA') is defined as an average angle between the pen and the dry media sheet, based upon the angle of the orifice plate to a least squares slope of the paper in the print zone. Such angle is measured in a plane normal to the direction of print media carriage travel.

FIG. 1 shows an inkjet pen 10 and a conventional print media handling system 12. The inkjet pen 10 includes a plurality of nozzles 15 for emitting ink at a printhead 14. The print zone 18 occurs adjacent to the printhead in the region of the nozzles. The media handling system 12 includes a drive roller 20, a pinch roller 22, and a platen 24. The drive roller 20 and pinch roller 22 are positioned adjacent to an entrance area of the print zone 18. The pinch roller 22 pushes a print medium 16 to the drive roller 20. As the drive roller 20 rotates, the print medium 16 is driven along the drive roller, then onto and along the adjacent platen 24. The platen 24 includes a contoured region 26 and a generally flat expanse 28. The contoured region 26 is positioned generally adjacent to the printhead 14. The print zone 18 is located between the platen's contour region 26 and the printhead 14. In operation nozzles 15 drop or eject ink droplets onto an upper surface of the print medium 16 as the print medium is moved in a direction of travel along the platen 24.

Typically the printhead 14 is horizontally positioned so that the nozzles 15 emit ink droplets from an underside of the pen 10. Alternatively, the printhead 14 is angled or vertically oriented with the print medium 16 being correspondingly oriented in the print zone to receive emitted ink droplets. The ink typically includes a large portion of water such that when the ink is printed onto the print medium 16, the ink at times saturates component print medium fibers. This saturation causes the fibers to expand, which in turn causes buckling or cockling of the print medium material.

The media sheet 16 is characterized as having a reverse bow within the contoured region 26 and a droop bow at the edge of the contoured region. The term "reverse" in "reverse bow" is used because the media sheet curvature is opposite that which is induced by the feed roller 20. The purpose of the varying curvature is to reduce cockling of the media sheet.

SUMMARY OF THE INVENTION

According to the invention, a media handling system reduces cockle growth on a media sheet by printing with a reduced number of nozzles while the data rate of incoming data is less than the full or mechanically limited print speed. During a print job, the printer receives incoming data corresponding to characters, symbols or graphics to be printed onto a media sheet. One of the most severe causes of cockle growth on a media sheet occurs when data coming into the printer is delayed during the print job and the printer stops to wait for more data to arrive. During this pause cockle growth continues. Cockle growth moves into the newly wetted areas of the media sheet and may deform adjacent dry areas.

According to one aspect of the invention, the print swath is reduced while the data rate of incoming data is less than the print speed. A reduced print swath is achieved by using only a portion of the nozzles in each row of an inkjet printhead. In particular, the most downstream nozzles are used while the most upstream nozzles are not used. An advantage of only using the most downstream nozzles is that the media sheet area receiving the wet ink is closer to the downstream edge of the print zone and soon away from the printhead. Thus, the wet ink areas where cockle growth is most likely to occur move out of the print zone more quickly (relative to the time ink is first received onto such area). As a result deviations in printhead to media sheet angle (PMSA) and printhead to media sheet spacing (PMSS) are minimized.

The media handling system includes a support along which or over which the media sheet moves in passing through the print zone. An upstream pinch roller is located along the media path prior to the print zone. An optional downstream pinch roller may be located along the media path after the print zone. The support and pinch rollers stabilize the media sheet white the media sheet moves through the print zone. The downstream pinch roller may be of a star wheel configuration to minimize contact with the media sheet and avoid smudging the wet ink on the media sheet. A function of the downstream pinch roller is to hold the media sheet down and away from the inkjet printhead.

Another function is to assist in advancing the media, especially once the media sheet trailing edge has passed beyond the upstream pinch roller.

According to another aspect of the invention, a guide shim is operatively positioned with the upstream pinch roller. The guide shim extends along the media path beyond the upstream pinch roller toward the print zone. The guide shim abuts or comes close to the print zone. The location of a lead edge of the guide shim relative to the print zone determines the minimum bottom margin for the inkjet printing device. One function of the guide shim is to provide media advance accuracy as the media sheet trailing edge departs contact with the upstream pinch roller and continues on to the print zone. Another function is to maintain the media flatness as the media sheet continues to the print zone. The guide shim serves to keep the media sheet under the inkjet printhead as the media sheet moves under the printhead. Cockle growth is limited by maintaining such flatness.

According to another aspect of this invention, the guide shim advances with the bottom edge of the media sheet into the print zone. As the guide shim is advanced, it keeps the media sheet in contact with the support, providing advance accuracy, minimal paper to pen spacing, and media trailing edge flatness. The movement of the shim into the print zone also allows the minimum bottom margin to decrease.

According to another aspect of the invention, the support is an endless belt loop driven by drive rollers. Preferably the belt has a ribbing or a grit coating. The media sheet rests on the belt and is stationary relative to the belt while moving through the print zone. The belt provides a continuous surface moving uniformly from the upstream pinch roller to the downstream pinch roller. A belt having ribs serves to reduce cockle growth on the media sheet. A belt having a grit coating, instead of ribs, maintains more accurate referencing between the media sheet and the belt, but is less effective at reducing cockle growth.

According to an alternative aspect of this invention, the support is a stationary platen which extends at least the length of the print zone. The media sheet is fed from the upstream pinch roller onto the platen, through the print zone and to the downstream pinch roller, when present. The upstream pinch roller in combination with a drive roller and the downstream pinch roller in combination with another drive roller advance the media sheet.

An advantage of the method of this invention is that cockle growth is minimized. This is particularly beneficial for media handling system embodiments which do not introduce a reverse bow into the media sheet, such as one which use a flat belt. One advantage of the support, pinch roller, and guide shim configuration is that media advance accuracy is maintained, and cockle growth is controlled, even while the media sheet trail edge leaves contact with the upstream pinch roller. A beneficial effect is that the minimum bottom margin is reduced. An advantage of the shim is that media advance accuracy is maintained even for pinch rollers which do not spin at identical speeds (e.g., due to manufacturing tolerances). These and other aspects and advantages of the invention will be better understood by reference to the following detailed description taken in conjunction with the accompanying drawings.

BRIEF DESCRIPTION OF THE DRAWINGS

FIG. 7 is a diagram of a portion of an inkjet printing apparatus according to another embodiment of this invention;

FIG. 8 is a diagram of the inkjet printing apparatus of FIG. 7 showing the guide shim in an advanced position;

DESCRIPTION OF SPECIFIC EMBODIMENTS

Figure 1:
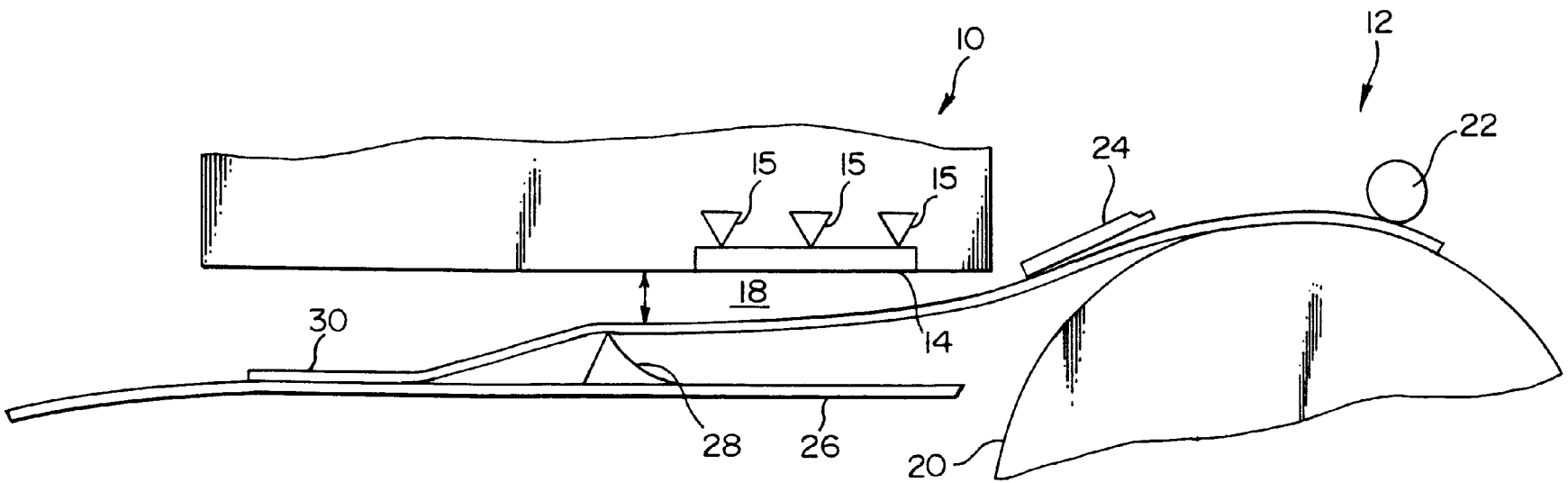
FIG. 1 PRIOR ART
FIG. 1 is a diagram of a portion of a conventional media handling system having an incline for reducing cockle growth.
Figure 2:
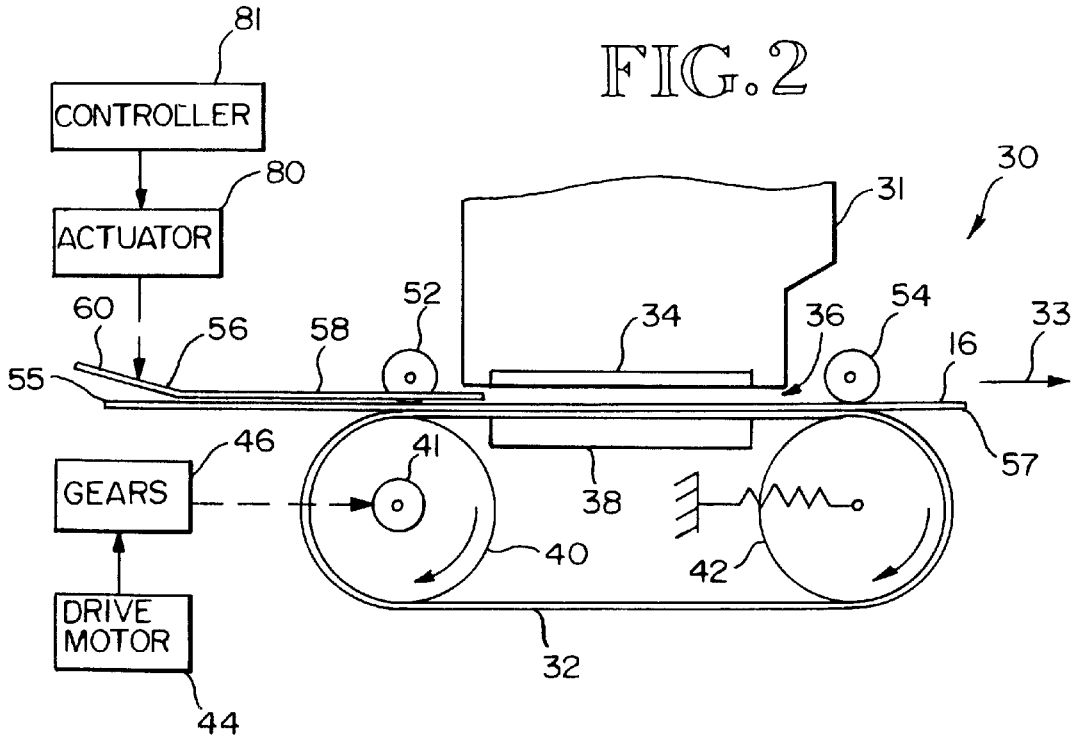
FIG. 2 is a diagram of a portion of an inkjet printing apparatus according to an embodiment of this invention.

Referring to FIG. 2, an inkjet printing apparatus 30 implements a method for reducing cockle growth according to an embodiment of this invention. The inkjet printing apparatus 30 includes an inkjet pen 31 having a printhead 34. In various embodiments the inkjet pen 31 is a scanning type pen which moves orthogonal to the direction of motion of a media sheet 16 along its media path, or a page wide array pen which is stationery or moves relative to the media handling components. The inkjet printhead 34 includes a plurality of inkjet nozzles 35 (see FIG. 3) which eject ink onto a media sheet 16 during printing. The nozzles are arranged in a plurality of rows. In one embodiment the nozzle rows extend along the direction of the media path direction 33.

The media sheet 16 is moved along a media path in a direction 33 by one or more rollers. Over a portion of the media path, the media sheet 16 is carried by a support 32. In a preferred embodiment the support is an endless belt loop. A print zone 36 occurs between the printhead 34 and the belt 32 in a region adjacent to the nozzles 35. The print zone 36 is the area where ink is ejected onto the media sheet 16. Within the print zone 36, a platen 38 maintains the belt 32 in a fixed orientation. As a result, the media sheet 16 is positioned at a known flat orientation within the print zone and ink is accurately applied to the media sheet 16.

Figure 4:
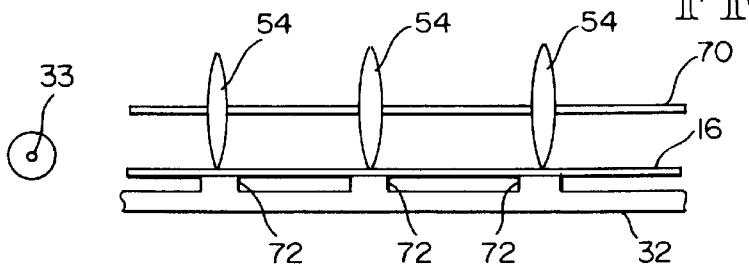
FIG. 4 is a cross sectional view of a portion of the belt and downstream star wheel pinch rollers of FIG. 2 according to one embodiment of this invention.
Figure 5:
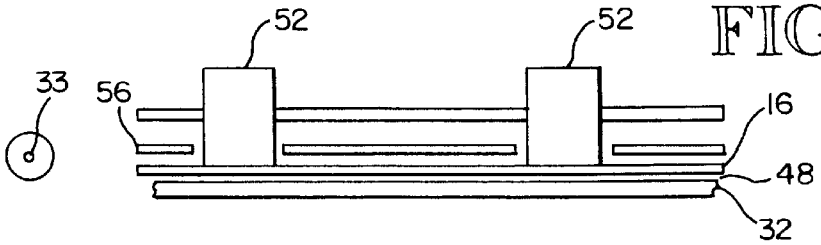
FIG. 5 is a cross sectional view of a portion of the belt, guide shim and upstream pinch rollers of FIG. 2 according to one embodiment of this invention.

The belt 32 runs along a drive roller 40 and an idler roller 42. One or more drive rollers 40 are mounted to a drive shaft 41. The drive shaft 41 is rotated by a drive motor 44 through a gear train 46 causing the belt 32 to move along the rollers 40, 42. The idler roller 42 preferably is spring-loaded to maintain the belt at a desired tension. Preferably, the belt 32 is stiff enough to prevent stretching over time. The belt 32 is reinforced with Kevlar in some embodiments to resist stretching. The spring-loading of idler roller 42 serves to maintain a desired belt tension even in the presence of some belt stretching. In one embodiment the belt is ribbed (see FIG. 4). The ribbing adds a measure of stability to the media sheet and allows the media sheet to cockle downward away from the printhead nozzles. In another embodiment the belt has a grit coating 48, rather than ribs (see FIG. 5). For the belt embodiment having a grit coating, particles are dispersed within or on top of a coating. In an exemplary embodiment, a polyurethane coating is used with a grit of aluminum oxide particles having an average particle size of 0.0005 inches to 0.005 inches. One of ordinary skill in the art will appreciate that other coating and particle sizes also may be used. The inventive concepts also apply for a smooth belt.

The printing apparatus 30 also includes an upstream pinch roller 52, an optional downstream pinch roller 54, and a guide shim 56. The upstream pinch roller 52 presses the media sheet 16 to an outer surface of the belt 32 in an area between the upstream pinch roller 52 and the drive roller 40 (see FIGS. 2 and 5). The downstream pinch roller 54 presses the media sheet 16 to an outer surface of the belt 32 in an area between the downstream pinch roller 54 and the idler roller 42 (see FIGS. 2 and 4). Preferably the downstream pinch roller 54 has a star wheel configuration which minimizes contact between the pinch roller 54 and the media sheet 16. This is desirable to avoid smudging the ink recently applied to the media sheet 16. The star wheel rollers 54 may be idle with individual mountings, or may be driven and have a common axle 70 (see FIG. 4). For the ribbed belt, the ribbing extending along the direction of motion 33. The media sheet 16 moves under the star wheel rollers 54 along the ribs 72 of belt 32.

The guide shim 56 includes a first portion 58 which is oriented generally parallel to the media path and a second portion 60 which is angled relative to the media path. The guide shim 56 second portion 60 is located upstream from the upstream pinch roller 52. The guide shim first portion 58 extends past the upstream pinch roller 52 toward the print zone 36. The guide shim second portion 60 is angled to direct an oncoming media sheet between the upstream pinch roller 52 and the drive roller 40 and onto the belt 32. The guide shim 56 serves to keep the media sheet 16 under the inkjet printhead 34 as the media sheet moves under the printhead 34. This is desirable to prevent cockling of the media sheet, in which the media sheet 16 bends upward into contact with the inkjet nozzles 35. Such contact can clog the inkjet nozzles 35 and cause inaccurate dot placement.

The guide shim portion 58 has a flat orientation relative to the media path through the print zone 36 as shown in FIG. 2. For a belt 32 having a grit coating 48, the upstream pinch roller 52 presses the media sheet into the grit coating, which in effect adds a degree of friction and stability to the position of the media sheet 16 relative to the belt 32. Such stability continues while the media sheet's trailing edge 55 passes beyond the pinch roller 52 toward the print zone 36. To reduce deterioration of the guide shim 56 by the grit coating 48 of the belt 32, a portion of the guide shim may be coated, such as with an ultra-high molecular weight polyethylene film. In a preferred embodiment the printing apparatus 30 also includes an actuator 80 which advances the guide shim 56 along the direction 33 of the media path.

Typically, a media sheet 16 is longer than the distance from the upstream pinch roller 52 to the downstream pinch roller 54 along the media path. As a result, at least one of the upstream pinch roller 52 and downstream pinch roller 54 is in contact with the media sheet 16 while ink is being ejected onto any portion of the media sheet 16. The pinch rollers 52, 54 introduce a measure of stability to the media sheet during printing. In one embodiment the belt 32 is ribbed. The ribbing adds another measure of stability to the media sheet which helps reduce loss of PMSS due to cockling of the media sheet 16. In addition the guide shim 56 holds a portion of the media sheet flat. The guide shim also serves to keep the media sheet under the inkjet printhead as the printhead 14 moves over the media sheet 16. This is desirable to prevent cockling of the media sheet where the media sheet bends upward into contact with the inkjet nozzles. Such contact can clog the inkjet nozzles 35 and cause inaccurate dot placement.

Thus, the guide shim 56 also aids in media advance accuracy as the media sheet trailing edge 55 departs contact with the upstream pinch roller 52 and continues on to the print zone 36. Specifically portion 58 of the guide shim 56 extends past the upstream pinch roller 52 toward and into the print zone 36. The shim 56 together with the star wheel contact of the downstream pinch roller 54 stabilizes the media sheet 16 as the trailing edge 55 moves toward and through the print zone 36.

Method for Reducing Cockle Growth

In operation the drive roller 40 is rotated causing the belt 32 to rotate. A lead edge 57 of the media sheet 16 is guided by the shim 56, the upstream pinch roller 52 and drive roller 40 onto the belt 32. The belt 32 carries the media sheet 16 as the drive roller 40 moves the belt 32 and the upstream pinch roller 52 presses a passing portion of the media sheet toward the drive roller 40. The belt 32 passes along the platen 38 carrying a portion of the media sheet 16 into the print zone 36. The printhead nozzles 35 eject ink onto the portion of the media sheet 16 within the print zone 36. The printed portion of the media sheet 16 is carried onward from the print zone 36 along belt 32 to the downstream pinch roller 54. The downstream pinch roller 54 presses the media sheet toward the idler roller 42. Preferably the downstream pinch roller 54 has a star wheel configuration which minimizes contact between the pinch roller 54 and the media sheet 16. This is desirable to avoid smudging the ink recently applied to the media sheet 16.

During a print job, the printer receives incoming data corresponding to characters, symbols or graphics to be printed onto a media sheet. One of the most severe causes of cockle growth on a media sheet occurs when data coming into the printer is delayed during the print job and the printer stops to wait for more data to arrive. During this pause cockle growth continues. Cockle growth moves into the wetted areas of the media sheet.

The printer 30 reduces cockle growth on a media sheet by printing with a reduced number of nozzles 35 while the data rate of incoming data is less than print speed. This applies while data is pending for a given print job, and excludes the decline in data rate when the all the data for a given print job has been received.

Figure 3:
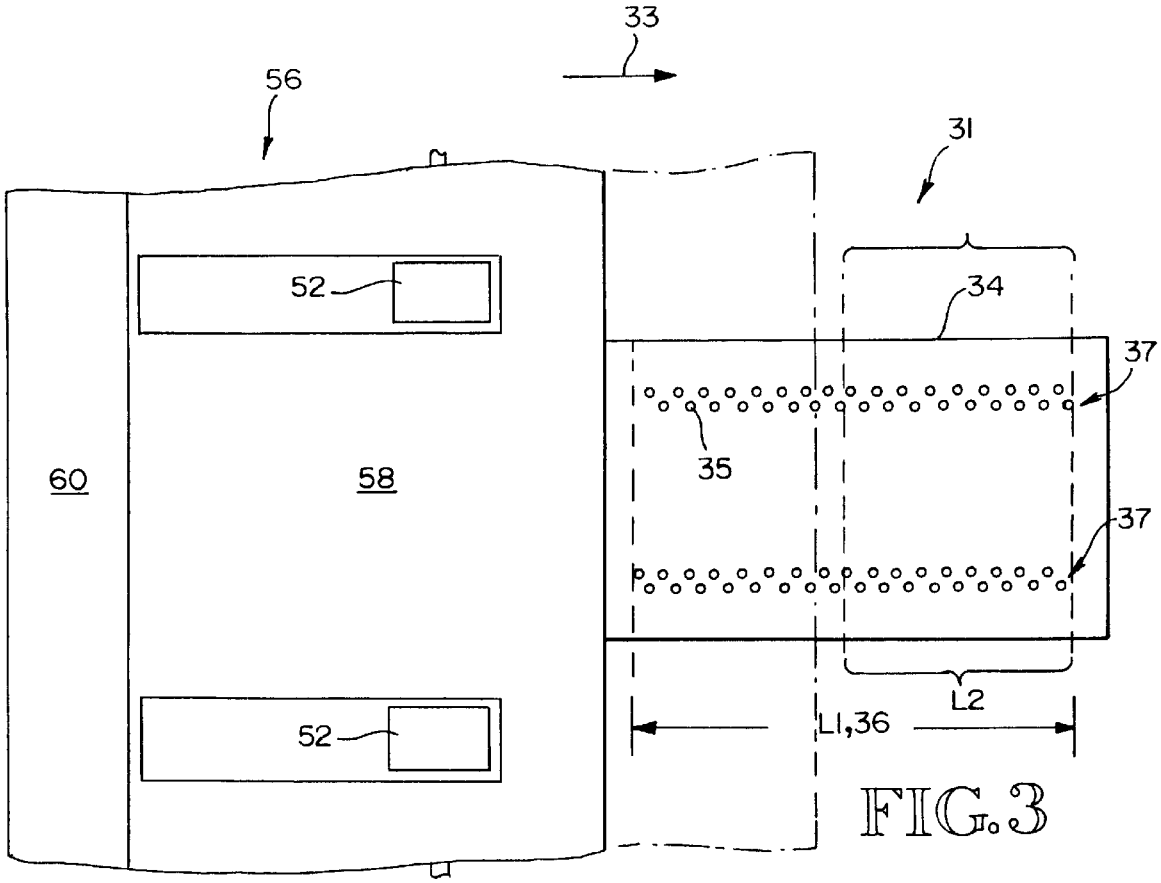
FIG. 3 is a diagram of the inkjet printhead and guide shim of FIG. 2.

Referring to FIG. 3, the printhead 34 include multiple rows 37 of nozzles 35. The rows 37 are oriented along the direction of media sheet movement 33 along the media path. Normally all nozzles 35 are available for use giving a print swath length of L1. Such swath length L1 spans the entire length of the print zone 36. Thus a media sheet may be paused in the middle of a print job with a printed portion of the media sheet spanning all or a part of the print zone 36. Such pause may allow cockle growth to extend into dry areas and to reach its maximum height before the media portion is moved out of the print zone. The cockle growth reduces printhead to media sheet spacing PMSS and may cause smearing of ink. To reduce cockle growth, the active print swath length is decreased to be less than L1 when the data rate for incoming data is less than the print speed at which the printhead can print to the media sheet. For example, the active print swath may be reduced to a length L2 which extends only a portion of the length of the print zone 36. Preferably the nozzles that remain active are those located furthest downstream on the printhead 34. As a result, the portion of the media sheet receiving ink clear the print zone after a shorter distance (e.g., distance L2). An advantage of only using the most downstream nozzles is that the media sheet area receiving the wet ink is closer to the downstream edge of the print zone and soon away from the printhead. Thus, the wet ink areas where cockle growth is most likely to occur move out of the print zone more quickly (relative to the time ink is first received onto such area). An advantage of only using the most downstream nozzles is that the rate at which ink is put onto the media sheet is reduced. Because the rate at which ink is desposited effects the cockle growth, the reduced deposition rate results in reduced cockle growth. Accordingly, printhead to media sheet angle (PMSA) and printhead to media sheet spacing (PMSS) are minimized.

Figure 6:
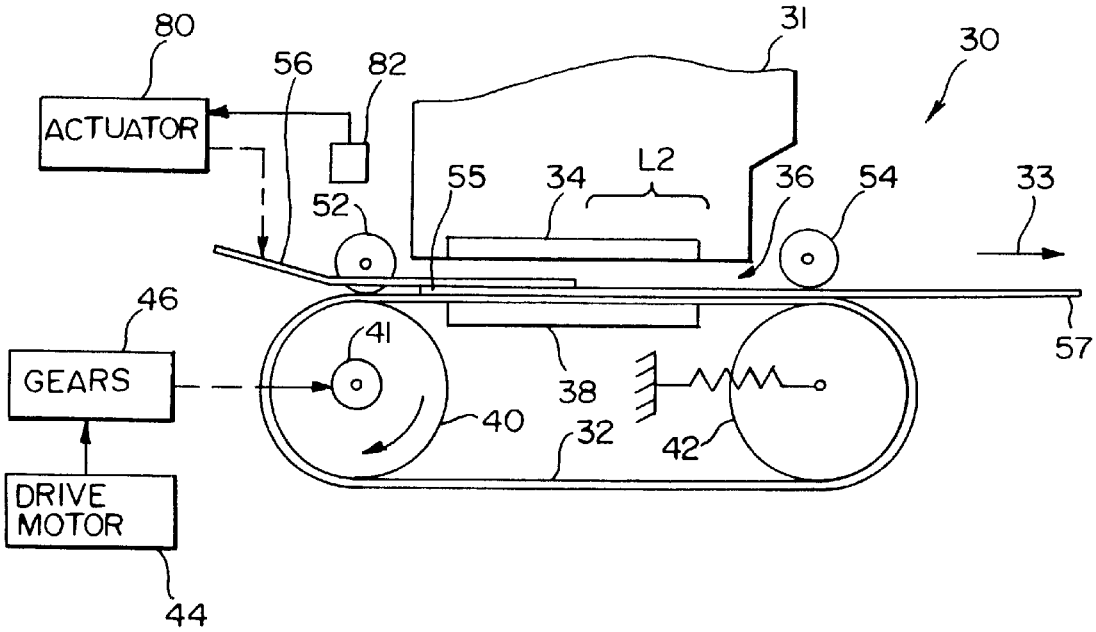
FIG. 6 is a diagram of the inkjet printing apparatus of FIG. 2 showing the guide shim in an advanced position.

In one embodiment, the guide shim 56 also is advanced into the normal print zone to provide additional control for keeping the media sheet flat near the active portion of the printhead (e.g., the active nozzles within length L2). The guide shim 56 is moved by the actuator 80 in response to a printer controller 81 (see FIG. 6).

Alternative Embodiments

Referring to FIGS. 7 and 8, a printing apparatus 130 is shown according to an alternative embodiment of this invention. Like parts of the apparatus relative to the components of the printing apparatus 30 of FIG. 2 are given the same part numbers and perform the same functions. In this apparatus 130, the support is formed by a platen 38' rather than an endless loop belt 32 (as in the apparatus 30 of FIG. 2). In addition, the downstream pinch rollers 54 are driven by a drive roller 132 (rather than an idler roller 42 as in FIG. 2). In various embodiment the platen 38' is stationary or moves with the trailing portion 55 of the media sheet 16 and the guide shim 56. For a stationary platen embodiment the platen 38' extends at least the length of the print zone 36. For a moving platen 38', the platen moves between a first position adjacent to the upstream pinch roller 52 and drive roller 40 to a second position adjacent to the downstream pinch roller 54 and the drive roller 132. The motion of the platen 38' is driven by an actuator 134. The motion of the platen 38' is mechanically linked or, at the least, synchronized to the movement of the guide shim 56.

Figure 9:
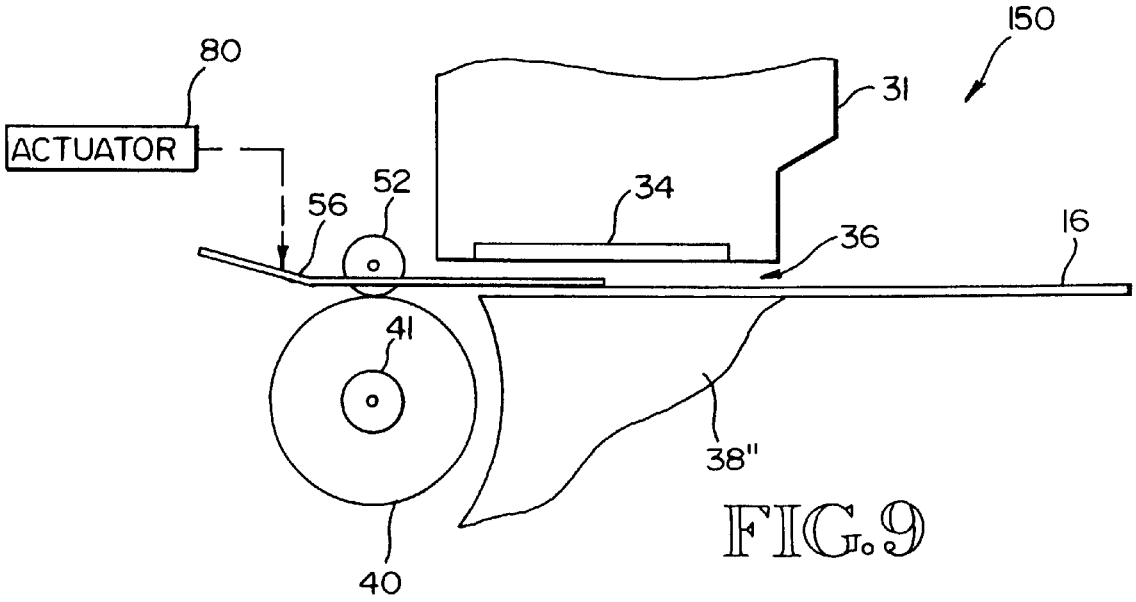
FIG. 9 is a diagram of a portion of an inkjet printing apparatus according to another embodiment of this invention.

Referring to FIG. 9, a printing apparatus 150 is shown according to an alternative embodiment of this invention. Like parts of the apparatus relative to the components of the printing apparatus 30 of FIG. 2 are given the same part numbers and perform the same functions. In this apparatus 150, the support is formed by a platen 38" rather than an endless loop belt 32 (as in the apparatus 30 of FIG. 2). In addition, the downstream pinch rollers 54 and corresponding idler roller 42 are omitted. The platen 38" is stationary during printing to a media sheet 60, although it may move (e.g., rotate downward) after printing to a media sheet. The platen 38" extends at least the length of the print zone 36. The guide shim 56 moves along a portion of the platen 38" with a trailing edge of the media sheet 60 to stabilize the media sheet. In particular, the guide shim 56 is advanced into the normal print zone to provide control for keeping the media sheet flat near the active portion of the printhead. The guide shim 56 is moved by the actuator 80 in response to a printer controller 81 (see FIG. 2).

Print Control

Figure 10:
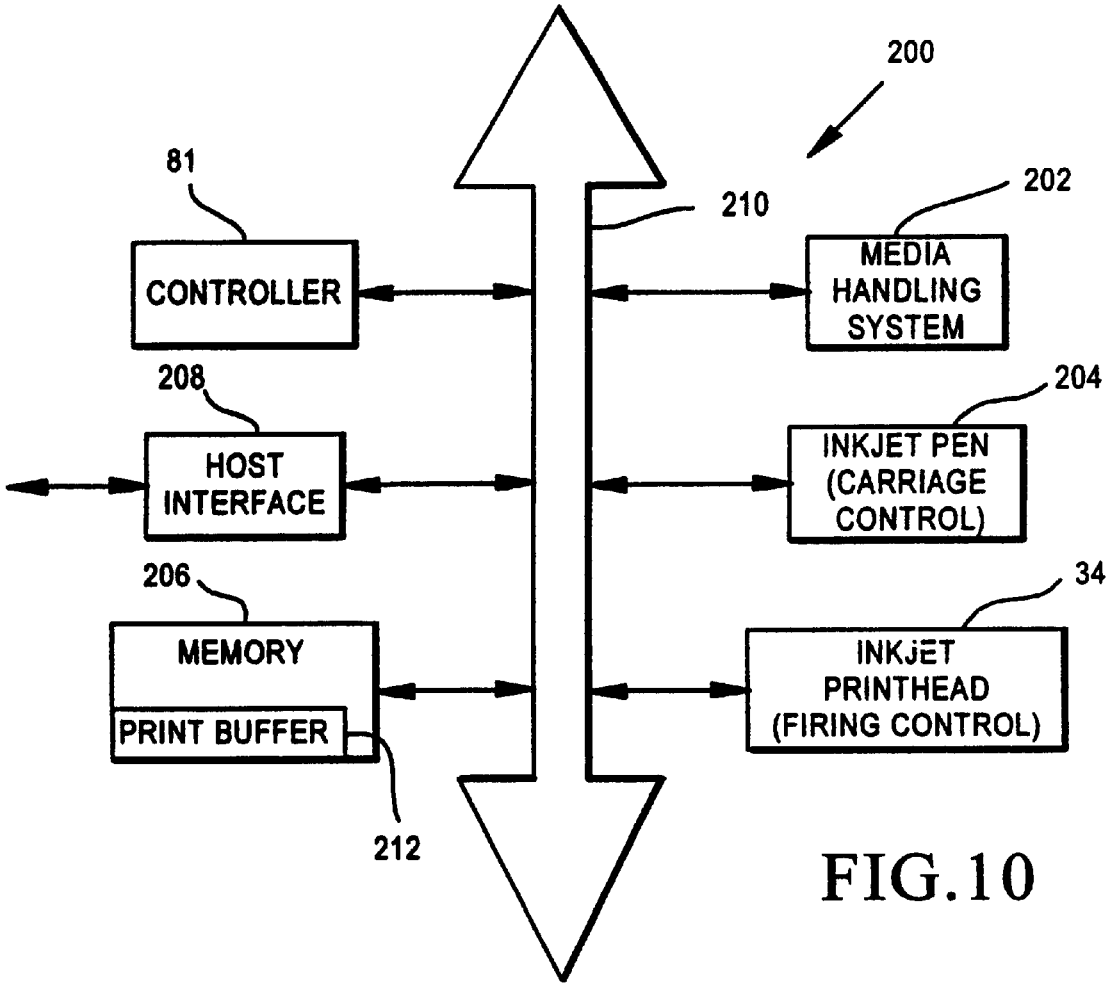
FIG. 10 is a block diagram of an inkjet printer apparatus.

Referring to FIG. 10, an inkjet printer 200 includes a controller 81, a media handling system 202, and inkjet pen 31 carriage control apparatus 204, an inkjet printhead 34, memory 206 and a host interface 208 which are interconnected through one or more busses 210. Data for a print job is received into the printer 200 from a host computer at the host interface 208 and stored in memory 206.

During a print operation, the data is moved out of memory 206 to define a firing control signal for the inkjet printhead 34. Media handling, inkjet pen carriage control and inkjet printhead nozzle firing are coordinated by the controller 81 to precisely place dots on a media sheet to form the desired characters, symbols or images.

Figure 11:
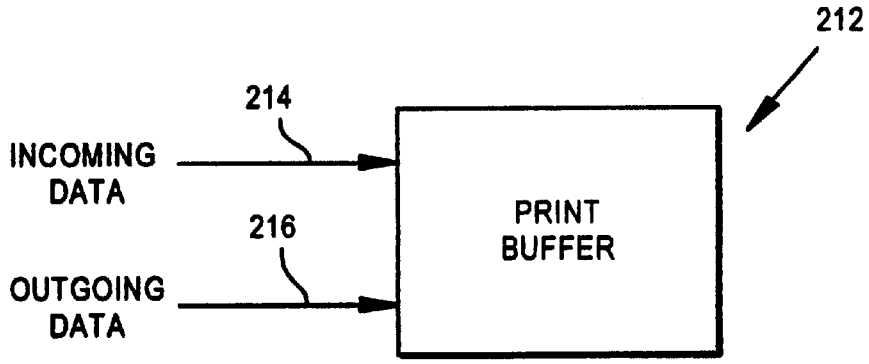
FIG. 11 is a diagram of a print buffer.

Referring also to FIG. 11, the memory 206 includes a circular print buffer 212 that receives incoming print data, while data also is moved out to perform the print job. In one embodiment the data is received from the host computer through the host interface 208. In another embodiment the data is received from a resident print queue, which earlier received the data from the host computer through the host interface 208. The circular buffer 212 is maintained in software with an incoming data pointer 214 and an outgoing data pointer 216.

Pointer 214 points to the next location of the buffer 212 for storing incoming data. Pointer 216 points to the next location of the buffer 212 from which data to be printed is output. It is desirable to keep the print buffer substantially full during a print job. When the incoming data rate equals the print speed, the print buffer 212 stays generally full. More specifically the amount of data being stored in the buffer stays generally constant. When the incoming data speed exceeds the print speed, the buffer 212 fills up. To prevent overfill (i.e., overwriting), the data input rate is slowed down using conventional protocols at the host interface 208. When the incoming data rate is less than the print speed, the amount of data stored in the print buffer 212 decreases as data is being moved out faster than it is being moved in. The controller 81 monitors the incoming data pointer 214 and outgoing data pointer 216 to determine the relation between the incoming data rate and the outgoing print speed.

During a print job the controller 81 reduces the number of nozzles 35 used by the printhead 34, while the incoming data rate is less than the print speed. This applies while data is pending for a given print job, and excludes the decline in the incoming data rate when all the data for an incoming print job has been received.

Meritorious and Advantageous Effects

An advantage of the method of this invention is that cockle growth is minimized. This is particularly beneficial for media handling system embodiments which do not introduce a reverse bow into the media sheet, such as one which use a flat belt. One advantage of the support, pinch roller, guide shim configuration is that media advance accuracy is maintained, and cockle growth is controlled, even while the media sheet trail edge leaves contact with the upstream pinch roller. A beneficial effect is that the minimum bottom margin is reduced. An advantage of the shim is that media advance accuracy is maintained even for pinch rollers which do not spin at identical speeds (e.g., due to manufacturing tolerances).

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A method for reducing cockle growth on a media sheet which moves along a media path through a print zone of an inkjet printing apparatus, the apparatus including an inkjet printhead having a plurality of inkjet nozzles which eject ink to print onto a media sheet at a print speed, the print zone located adjacent to the plurality of nozzles, the method comprising the steps of:

receiving data to the inkjet printing apparatus at an incoming data rate;

receiving the media sheet at a roller which stabilizes the media sheet along the media path relative to a first surface, the roller located upstream along the media path prior to the print zone;

while the incoming data rate is at least a great as the print speed, ejecting ink from a first plurality of the inkjet nozzles onto a portion of the media sheet located within the print zone, wherein the first plurality of inkjet nozzles span a first print swath length along a direction of media sheet travel, the first print swath length extending from a first location within the print zone;

detecting that the incoming data rate is less than the print speed;

in response to the step of detecting, ejecting ink from a second plurality of the inkjet nozzles onto a portion of the media sheet located within the print zone, wherein the second plurality of inkjet nozzles span a second print swath length along a direction of media sheet travel which is less than the first print swath length, and wherein the second print swath length extends from a second location within the print zone.

2. The method of claim 1, wherein the second location within the print zone is further downstream along the media path than the first location within the print zone.

3. The method of claim 1, further comprising the steps of:

moving the media sheet under a guide shim toward the print zone, the guide shim acting upon a portion of the media sheet to maintain flatness of the media sheet as the media sheet travels under the guide shim toward the print zone; and in response to the step of detecting, advancing the guide shim along the media path to a third location adjacent to the second location.

4. The method of claim 3, further comprising the steps of:

moving the media sheet onto a support; and in response to the step of detecting, advancing the support along the media path to underlie the third location within the print zone.

5. The method of claim 1, in which the roller is a first roller, and further comprising the step of receiving the media sheet at a second roller which stabilizes the media sheet along the media path relative to a second surface, the second roller located downstream along the media path after the print zone.

6. The method of claim 5, in which the inkjet printing apparatus includes an endless belt which supports the media sheet as the media sheet passes along the media path through the print zone, wherein the step of receiving the media sheet at the first roller comprises pressing the media sheet to the endless belt.

7. The method of claim 6, wherein the step of receiving the media sheet at the second roller comprises pressing the media sheet to the endless belt, the endless belt comprising the first surface and the second surface.

8. An inkjet printing apparatus which moves a media sheet along a media path and marks the media sheet with ink, comprising:

an inkjet printhead having a plurality of inkjet nozzles which eject ink onto a portion of the media sheet located within a print zone, the print zone located adjacent to the plurality of nozzles, wherein the plurality of inkjet nozzles includes a first plurality of the inkjet nozzles which span a first print swath length, the first print swath length extending from a first location within the print zone, wherein the plurality of inkjet nozzles includes a second plurality of the inkjet nozzles which span a second print swath length, the second print swath length extending from a second location within the print zone;

a roller located upstream along the media path prior to the print zone, the roller stabilizing the media sheet relative to a first surface during printing onto at least a first portion of the media sheet;

means for determining when an incoming data rate at which print data is received is less than a print speed at which ink is ejected onto the media sheet;

means for decreasing print swath height in response to a determination that the incoming data rate is less than print speed from the first print swath length to the second print swath length.

9. The apparatus of claim 8, wherein the second location within the print zone is further downstream along the media path than the first location within the print zone.

10. The apparatus of claim 8, further comprising:

a support which supports the media sheet as the media sheet passes along the media path through the print zone;

a guide shim located along the media path, the guide shim having a guide surface extending at least from the roller, to beyond the roller toward the print zone, the guide shim acting upon a portion of the media sheet between the roller and the print zone to keep the media sheet out of contact with the printhead; and means for advancing the guide shim along the media path.

11. The apparatus of claim 10, in which the advancing means comprises means for advancing the guide shim into the print zone.

12. The inkjet printing apparatus of claim 10, in which the support is an endless belt, and wherein the endless belt comprises an outer surface upon which the media sheet rests, the outer surface being said first surface and said second surface.

13. The apparatus of claim 10, further comprising:

means for advancing the support along the media path to underlie a distal edge of the guide shim.

14. The apparatus of claim 10, in which the roller is a first roller, and further comprising a second roller located downstream along the media path after the print zone, the second roller stabilizing the media sheet relative to a second surface during printing onto at least a second portion of the media sheet.

* * * * *